US012522963B2

(12) United States Patent
Sakuma et al.

(10) Patent No.: US 12,522,963 B2
(45) Date of Patent: Jan. 13, 2026

(54) SEWING MACHINE

(71) Applicant: Suzuki Manufacturing, Ltd., Yamagata (JP)

(72) Inventors: Tohru Sakuma, Yamagata (JP); Mitsuru Sato, Yamagata (JP)

(73) Assignee: Suzuki Manufacturing, Ltd., Yamagata (JP)

( * ) Notice: Subject to any disclaimer, the term of this patent is extended or adjusted under 35 U.S.C. 154(b) by 0 days.

(21) Appl. No.: 18/868,962

(22) PCT Filed: Dec. 11, 2023

(86) PCT No.: PCT/JP2023/044296
§ 371 (c)(1),
(2) Date: Nov. 25, 2024

(87) PCT Pub. No.: WO2024/180855
PCT Pub. Date: Sep. 6, 2024

(65) Prior Publication Data

US 2025/0369167 A1 Dec. 4, 2025

(30) Foreign Application Priority Data

Mar. 1, 2023 (JP) ..... 2023-030638

(51) Int. Cl.
*D05B 61/00* (2006.01)
*D05B 9/00* (2006.01)
*D05B 29/08* (2006.01)

(52) U.S. Cl.
CPC ..... *D05B 61/00* (2013.01); *D05B 9/00* (2013.01); *D05B 29/08* (2013.01)

(58) Field of Classification Search
CPC ..... D05B 1/10; D05B 57/32; D05B 57/34; D05B 57/36; D05B 29/08; D05B 61/00; D05B 9/00
See application file for complete search history.

(56) References Cited

U.S. PATENT DOCUMENTS 5,383,414 A * 1/1995 Winter ..... D05B 53/00 112/162
5,517,933 A * 5/1996 Karaba, Jr. ..... D05B 1/20 112/475.26

(Continued)

FOREIGN PATENT DOCUMENTS

CN 102206902 A 10/2011
CN 101195948 A 6/2018

(Continued)

OTHER PUBLICATIONS

International Search Report and English Translation.

(Continued)

*Primary Examiner* — Danny Worrell
(74) *Attorney, Agent, or Firm* — BACON & THOMAS,PLLC

(57) ABSTRACT

The sewing machine includes: a presser foot 1 which holds down a fabric on a throat plate 18; a presser holder 8 which supports the presser foot 1; a rotatable spreader 3 having a thread hole 14 through which sewing thread vertically passes; a spreader drive mechanism 4 which drives the rotation of the spreader 3; a reciprocating motion conversion mechanism 5 which converts the rotation of an upper shaft 7 into a linear reciprocating motion; and a link mechanism 6 which transmits the reciprocating motion produced by the reciprocating motion conversion mechanism 5 to the spreader drive mechanism 4. The spreader 3 and the spreader drive mechanism are both provided on the presser foot. The link 6 mechanism is provided on the presser holder 8.

11 Claims, 9 Drawing Sheets

(56) References Cited

U.S. PATENT DOCUMENTS

| | | | | |
|---|---|---|---|---|
| 7,918,171 | B2 * | 4/2011 | Miyoshi | D05B 87/02 112/225 |
| 8,661,997 | B2 | 3/2014 | Sakuma et al. | |
| 9,297,101 | B2 | 3/2016 | Sakuma | |
| 11,926,945 | B2 * | 3/2024 | Mifuji | D05B 1/10 |
| 2021/0087728 | A1 | 3/2021 | Suzuki | |

FOREIGN PATENT DOCUMENTS

| | | | |
|---|---|---|---|
| EP | 4089219 | A1 | 11/2022 |
| JP | S54-102368 | U1 | 7/1979 |
| JP | S56-104694 | A | 8/1981 |
| JP | 2001-120864 | A | 5/2001 |
| JP | 2003-169982 | A | 6/2003 |
| JP | 2012-176302 | A | 9/2012 |
| TW | 200916623 | A | 4/2009 |
| TW | M503424 | U | 6/2015 |
| WO | WO2014/069028 | A1 | 5/2014 |

OTHER PUBLICATIONS

Written Opinion by International Search Authority.
Office Action dated May 21, 2024 issued in corresponding Taiwan Patent Appln.

* cited by examiner

SEWING MACHINE

TECHNICAL FIELD

The present invention relates to a sewing machine that forms decorative stitches on the upper surface of a fabric.

BACKGROUND ART

Hitherto, there have been known a pair of left and right spreaders and a drive mechanism thereof provided in a sewing machine to enable decorative stitching on the upper surface of a fabric (refer to Patent Literature 1 below). In this mechanism, the drive force of a drive shaft is distributed to each spreader in order to perform the symmetrical operation of the left and right spreaders.

More specifically, a first support arm, which supports one spreader, is fixed to a drive shaft so as to be directly driven by the drive shaft. A second support arm, which supports the other spreader, is driven by the drive shaft via a link mechanism connected to the first support arm.

Further, there has conventionally been proposed an apparatus in which a belt-shaped spreader is built in a presser foot to prevent contact with the spreader from outside and to allow installation to a multifunction machine (refer to Patent Literature 2 below). In this apparatus, the movement of a needle bar is used as a driving source, and a link mechanism that transmits the driving force to the spreader is provided at a position away from a presser rod that supports the presser foot.

In addition, there has conventionally been proposed a sewing machine provided with a mechanism that allows a spreader drive device to be attached and detached so as to prevent a spreader from interfering with sewing and to secure safety (refer to Patent Literature 3 below).

CITATION LIST

Patent Literatures

Patent Literature 1: Japanese Utility Model Application Publication No. S54-102368

Patent Literature 2: Japanese Patent Application Laid-Open No. 2001-120864

Patent Literature 3: Japanese Patent Application Laid-Open No. 2003-169982

SUMMARY OF INVENTION

Technical Problem

However, according to the configuration described in Patent Literature 1, the left and right spreaders have different power transmission paths, so that there is an inconvenience that the left and right spreaders do not symmetrically operate due to clearance or wear of moving parts.

Further, according to the configuration described in Patent Literature 2, the power transmission structure including the belt-shaped spreader is exposed behind the presser foot, thus leading to a risk of coming in contact with an operator's finger during a sewing operation, and also adversely affecting the appearance.

Further, according to the configuration described in Patent Literature 3, when the upper surface decorative stitching is not performed, the spreader that has been removed may be lost. In addition, detaching and reattaching the spreader is bothersome and inconvenient.

In view of the above, an object of the present invention is to provide a sewing machine that not only prevents a spreader from interfering with a sewing operation so as to ensure smooth sewing, but also provides high safety, a good appearance, and ease of use.

Solution to Problem

To this end, the present invention provides a sewing machine adapted to form a decorative stitch on an upper surface of a fabric, the sewing machine including: a presser foot which is adjacent to a sewing needle moving up and down and which holds down the fabric on a throat plate; a presser holder which supports the presser foot; a rotatable spreader which has a thread hole through which sewing thread vertically passes; a spreader drive mechanism which drives the rotation of the spreader; a reciprocating motion conversion mechanism which is positioned above the throat plate and converts the rotation of an upper shaft into a linear reciprocating motion in a longitudinal direction; and a link mechanism which transmits a reciprocating motion produced by the reciprocating motion conversion mechanism to the spreader drive mechanism, wherein the spreader and the spreader drive mechanism are both provided in the presser foot, and the link mechanism is provided in the presser holder.

According to the present invention, the spreader and the spreader drive mechanism are provided in the presser foot, and the link mechanism is provided in the presser holder, thus suppressing a rotating spreader from coming in contact with an operator's finger, or the like during a sewing operation. This permits smooth and safe sewing operations. In addition, for example, the exposure of the power transmission components involved in the path from the reciprocating motion conversion mechanism to the spreader drive mechanism via the link mechanism can be minimized, resulting in a neat appearance.

Further, in the present invention, the presser foot includes a pivot shaft which is positioned behind the sewing needle and vertically extends, the spreader includes a main body supported by the pivot shaft, a cam groove which is formed in the main body and curved along a rotation path, and an arm portion which extends forward from the main body and has the thread hole formed therein, and the spreader drive mechanism includes a slider which moves toward and away from the pivot shaft by a reciprocating motion transmitted from the reciprocating motion conversion mechanism via the link mechanism, and a cam follower which is provided on the slider and which rotates the spreader by sliding along the cam groove of the spreader as the slider moves.

In this instance, preferably, the thread hole is formed in an elongated hole shape, and the elongated hole shape is gradually enlarged as the distance from the pivot shaft increases. In other words, the thread hole is formed smaller on the pivot shaft side and becomes larger as the distance from the pivot shaft increases.

When threading a sewing needle to form stitches, a decorative thread is passed through a thread hole formed in the arm portion of the spreader and tensioned. At this time, if the thread hole is formed to be smaller on the pivot shaft side, then a change in the position where the decorative thread is tensioned can be reduced, making it possible to suppress the occurrence of skipped stitches. On the other hand, the thread hole is formed to be larger at a position away from the pivot shaft side, thus allowing the decorative thread to be easily passed through the thread hole.

Further, preferably, the spreader is composed of a pair of symmetrically-shaped rotating members including the main bodies, the cam grooves, and the arm portions, both of the rotating members are rotatably supported on the pivot shaft, and the thread holes of both members move in opposite directions from each other when the cam follower moves as the slider moves forward and backward.

According to this arrangement, the power transmission paths to the pair of rotating members constituting the spreader are the same on the left and right, so that both rotating members constituting the spreader symmetrically operate even if there is a clearance or wear of the moving parts. In addition, the drive mechanism can be made extremely compact, allowing the drive mechanism to be installed in a relatively small space such as in a presser foot.

Further, in the present invention, the presser foot includes a cloth presser member which is brought into contact with a fabric on the throat plate, and a connection member which is provided on the upper surface side of the cloth presser member and connected to the presser holder, and the spreader and the spreader drive mechanism are provided between the cloth presser member and the connection member.

Making the spreader smaller allows the spreader and the spreader drive mechanism to be provided between the cloth presser member and the connection member. Thus, the spreader drive mechanism is housed between the cloth presser member and the connection member, making it possible to prevent contact with a finger or the like of an operator during a sewing operation.

Further, in the present invention, the link mechanism includes a link member which is elongated in the vertical direction along the presser holder, and a swing support part provided on the presser holder to support the link member in such a manner as to be swingable between the upper end and the lower end of the link member. The reciprocating motion of the reciprocating motion conversion mechanism is input from the upper end of the link member and the reciprocating motion is output from the lower end of the link member toward the spreader drive mechanism.

In this instance, the presser holder preferably includes a link mechanism housing which accommodates the link mechanism, and a cover member which detachably seals the link mechanism housing to conceal the link mechanism accommodated in the link mechanism housing.

Thus, the link mechanism is accommodated in the link mechanism housing of the presser holder, and further, the link mechanism accommodated in the link mechanism housing is concealed by the cover member, so that the moving components are not exposed, making it possible to maintain safety and improve the appearance.

Further, in the present invention, the reciprocating motion conversion mechanism includes: a cam rotated by the upper shaft; a yoke which converts the rotation of the cam into a linear reciprocating motion; a transmission pin which transmits the reciprocating motion of the yoke to the link mechanism; and a presser height detector for maintaining a constant distance between the transmission pin and a fulcrum of the link mechanism, and the presser height detector is supported on a frame of the sewing machine in such a manner as to be vertically movable, and connects a presser rod, which supports the presser holder, and the yoke.

When a fabric thickness changes during a sewing operation, the height of the yoke has to be adjusted accordingly. If the height of the yoke cannot be adjusted, the distance between the transmission pin and the fulcrum of the link mechanism cannot be maintained constant, inconveniently changing the swing angle and range of the spreader. This leads to an inconvenience that beautiful stitches are not stably formed. In contrast, according to the present invention, the yoke provided with the transmission pin moves up and down integrally with the presser rod due to the above-described configuration, so that beautiful stitches can be stably formed even if the fabric thickness changes.

Further, the yoke includes a base on which the transmission pin is provided, and two wall portions which are positioned in opposing directions via a rotating shaft of the cam and which are in contact with the cam. The base includes an urging member which supports both wall portions in such a manner as to be separately and horizontally movable and which urges both wall portions in directions toward each other. Both wall portions can be configured to move against the urging of the urging member in directions away from each other to release the transmission of power from the reciprocating motion conversion mechanism to the link mechanism in response to a rotational stopping force applied to the spreader.

If the spreader should come in contact with a finger, or if a thread on the upstream relative to the spreader should become entangled, an excessive load may be applied to the spreader. According to the present invention, if an excessive load should be applied to the spreader, the urging member that draws the two wall portions together stretches due to the above-described configuration, thereby making it possible to restrict the drive of the spreader. Therefore, in such a case, the function of releasing the transmission of the driving force to the spreader is obtained, and the load on the spreader can be reduced to prevent the occurrence of failures or the like.

Further, in the present invention, the link mechanism includes a link disconnection mechanism which is connected to the reciprocating motion conversion mechanism by engaging with a part of the reciprocating motion conversion mechanism and which disconnects from the reciprocating motion conversion mechanism by separating from the part of the reciprocating motion conversion mechanism, and the link disconnection mechanism includes an operation lever for performing a disconnecting operation, and a moving member which moves the link member in a direction for releasing the engagement with the reciprocating motion conversion mechanism via the swing support part by the disconnecting operation performed by the operation lever.

This enables power to be turned on and off by a simple operation such as operating the operation lever. In addition, the power can be turned on and off regardless of the angle at which the main shaft of the sewing machine is positioned.

At this time, preferably, the moving member further moves the spreader to a predetermined position along an advancing/retreating direction via the link member by the disconnecting operation performed by the operation lever.

The lever operation is continued until the spreader moves to the predetermined position along the advancing/retreating direction. The power is turned off by operating the operation lever when the upper surface decorative stitching is not performed. In this case, moving the spreader to the predetermined position (specifically, a position where a sewing operation is not interfered with) makes it possible to smoothly perform the sewing operation that does not involve the upper surface decorative stitching. Further, the spreader can be smoothly threaded by setting the predetermined position, to which the spreader is to be moved, to a position where a sewing thread is passed through the spreader.

Further, preferably, the reciprocating motion conversion mechanism includes a transmission pin urged downward, and the link mechanism includes a recessed portion, which detachably engages with the transmission pin, in an upper end portion of the link member, and a contact surface which is formed continuously from an upper edge of one side of the recessed portion and with which the transmission pin can contact from above.

With the above-described configuration, when a manual lever is operated in a reverse direction to perform upper surface decorative stitching and then the upper surface decorative stitching is started, the transmission pin slides along the contact surface toward the recessed portion of the link mechanism, thus enabling the transmission pin to be securely fitted into the recessed portion.

DESCRIPTION OF EMBODIMENTS

Figure 1:
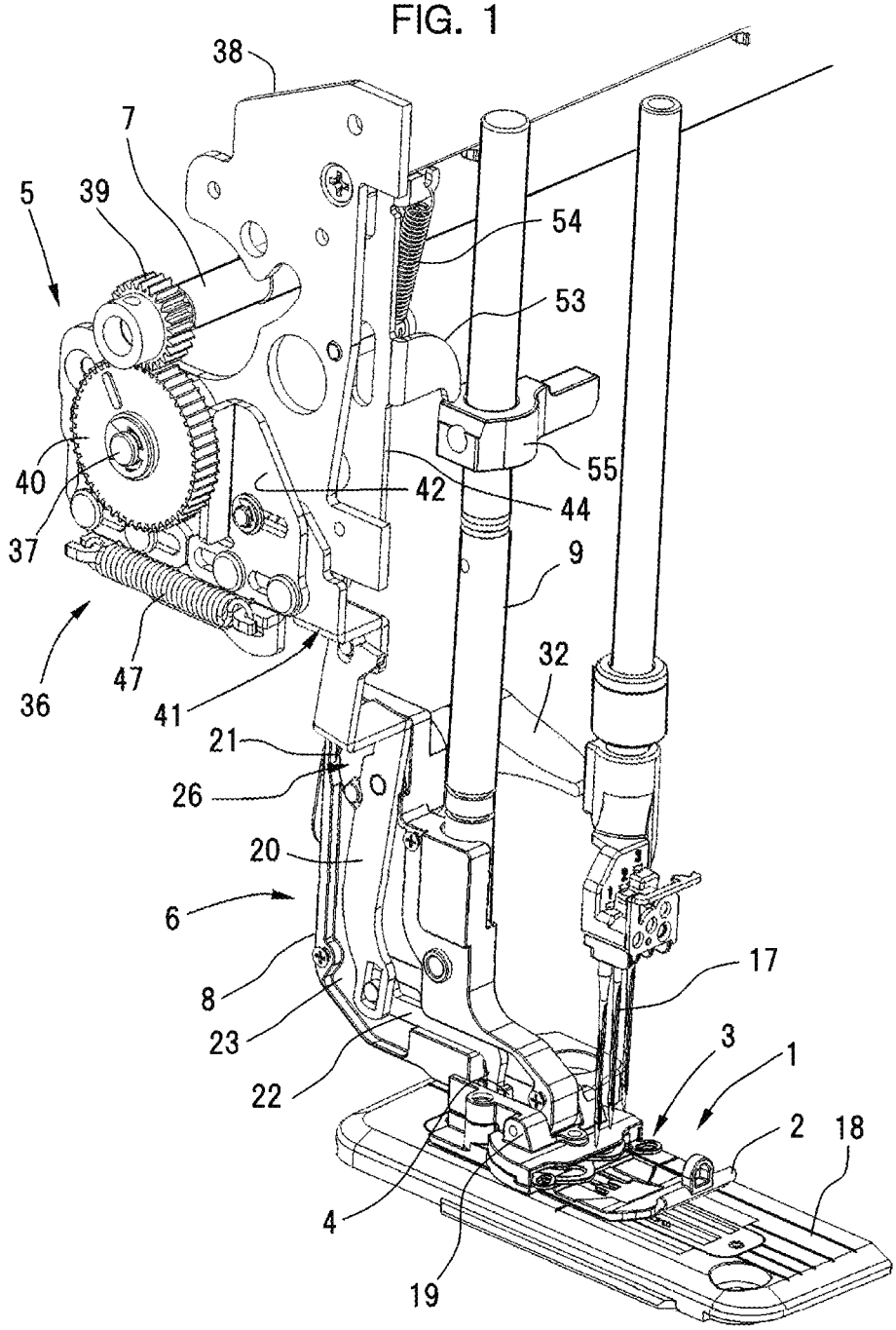
FIG. 1 is an explanatory perspective view illustrating an essential section of a sewing machine of an embodiment of the present invention.

An embodiment of the present invention will be described with reference to the accompanying drawings. The present embodiment is a sewing machine adapted to form decorative stitches on the upper surface of a fabric. Referring to the essential section illustrated in FIG. 1, the sewing machine of the present embodiment includes a spreader 3 provided on a cloth presser member 2 included in a presser foot 1, and a spreader drive mechanism 4 (refer to FIG. 3) that drives the spreader 3.

The driving force of an upper shaft 7 is transmitted to the spreader drive mechanism 4 via a reciprocating motion conversion mechanism 5 and a link mechanism 6.

In FIG. 1, although the reciprocating motion conversion mechanism 5 and the link mechanism 6 are shown in an exposed state for convenience of explanation, the reciprocating motion conversion mechanism 5 is accommodated in a sewing machine housing, which is not illustrated, and the link mechanism 6 is accommodated in a presser holder 8, as will be described later. The presser foot 1 is connected via the presser holder 8 to a presser rod 9 that vertically extends.

Figure 2:
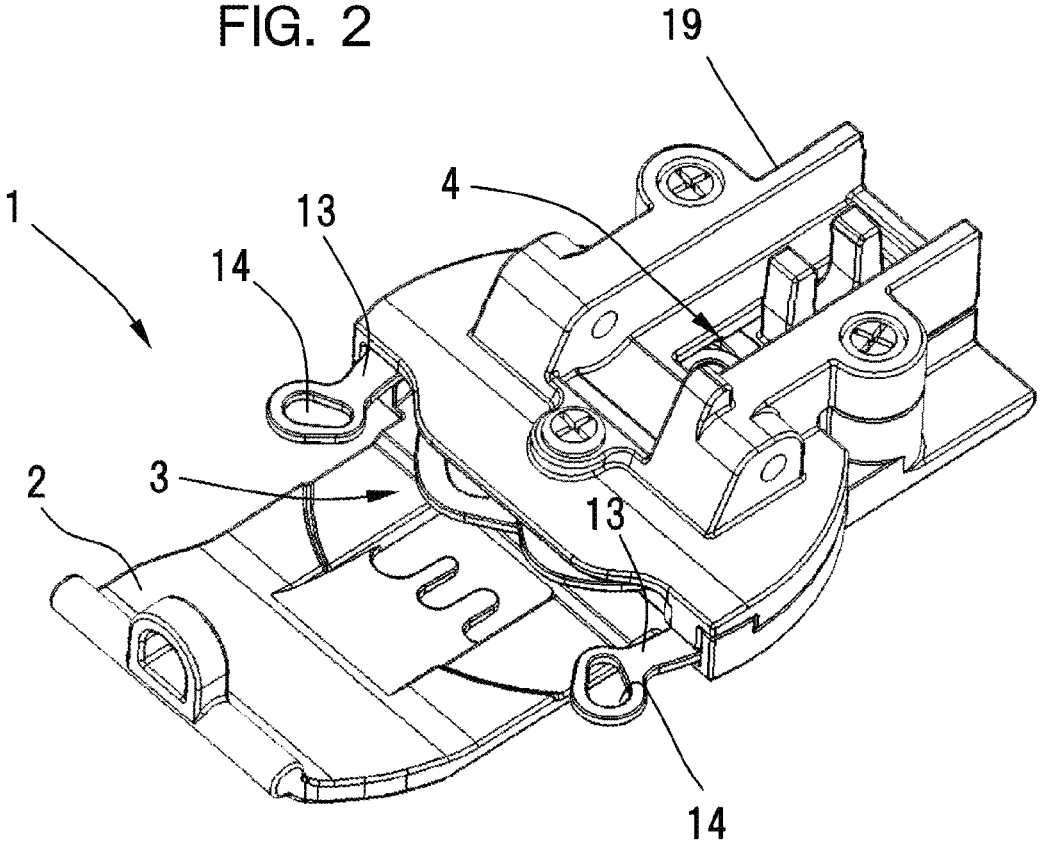
FIG. 2 is an explanatory perspective view illustrating the appearance of a presser foot.
Figure 3:
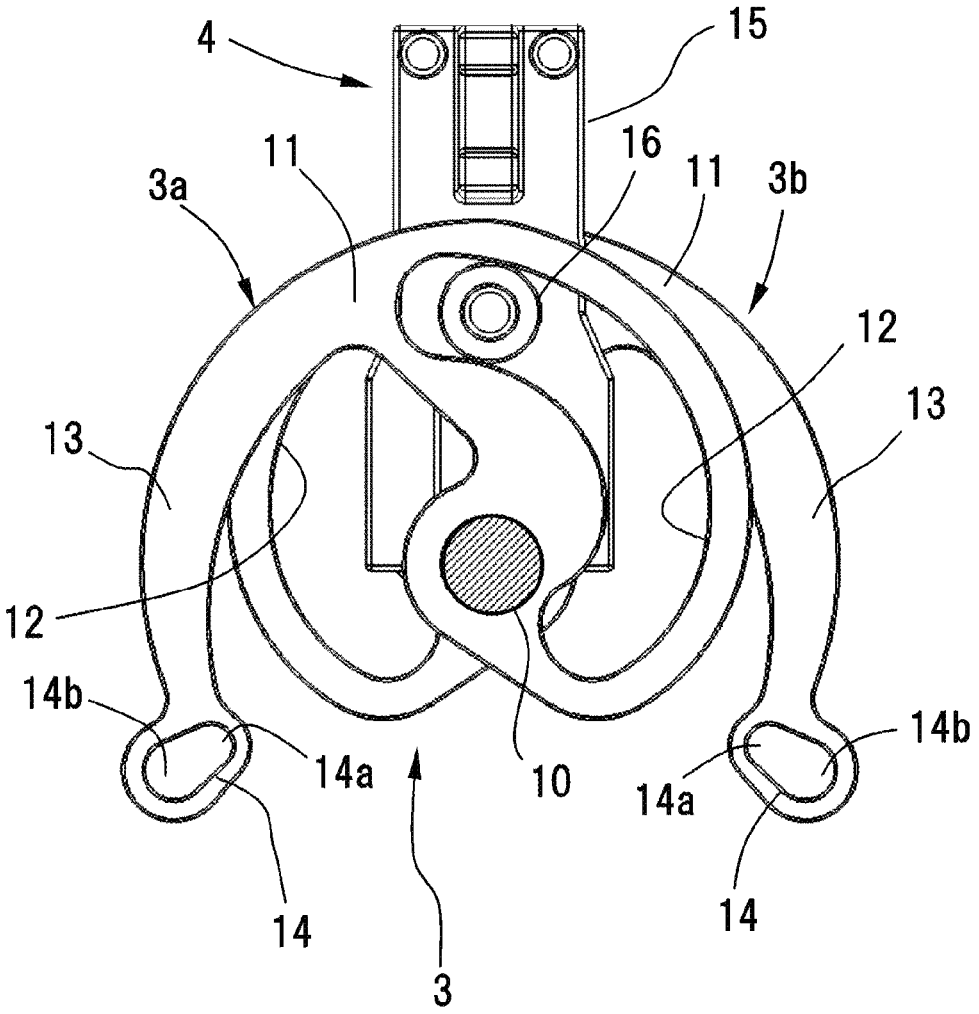
FIG. 3 is an explanatory perspective view illustrating a spreader and a spreader drive mechanism.

FIG. 2 illustrates the presser foot 1. The presser foot 1 is provided with the spreader 3. As illustrated in FIG. 3, the spreader 3 is composed of a pair of rotating members 3*a*, 3*b* formed of a metal plate material. The both rotating members 3*a*, 3*b* are symmetrical in shape, and are rotatably supported on a pivot shaft 10 in such a manner as to partly overlap in the vertical direction. The pivot shaft 10 is provided in the presser foot 1, and coaxially supports the both rotating members 3*a*, 3*b*.

Each of the rotating members 3*a*, 3*b* includes a main body 11 through which the pivot shaft 10 passes, a curved, elongated cam groove 12 formed in the main body 11, and an arm portion 13 extending from the main body 11.

A thread hole 14 is formed at the tip of the arm portion 13. The thread hole 14 has an elongated hole shape that extends toward the pivot shaft 10, and the elongated hole shape is gradually enlarged as the distance from the pivot shaft 10 increases.

More specifically, if the direction in which the both arm portions 13 approach each other is defined as the inner side and the direction in which they move away from each other is defined as the outer side, then the thread hole 14 is formed to have a shape in which a small-diameter hole portion 14*a* positioned on the inner side (the pivot shaft 10 side) and a large-diameter hole portion 14*b* positioned on the outer side (the side away from the pivot shaft 10) are continuous with each other.

A thread for decorative stitching (a decorative thread) is passed through the thread hole 14. The large-diameter hole portion 14*b* provided in the thread hole 14 permits easier threading of a decorative thread. In addition, the small-diameter hole portion 14*a* provided in the thread hole 14 makes it possible to reduce a change in the position where a decorative thread is tensioned during the rotational movement of the spreader 3, so that the occurrence of skipped stitches can be suppressed.

As illustrated in FIG. 3, the spreader drive mechanism 4 includes a slider 15 and cam followers 16. The slider 15 is positioned between the upper and lower rotating members 3*a*, 3*b* constituting the spreader 3 and is provided so as to be movable in the longitudinal direction along a fabric feed direction. The cam followers 16 are provided on the front and back of the slider 15, and slide along the cam grooves 12 of the rotating members 3*a*, 3*b*.

When the cam followers 16 slide along the curves of the cam grooves 12 as the slider 15 moves, the rotating members 3*a*, 3*b* of the spreader 3, which is rotatably supported by the pivot shaft 10, rotate in the directions opposite from each other. Thus, the both arm portions 13 of the spreader 3 move toward or away from each other according to the moving direction of the slider 15.

As illustrated in FIG. 1 and FIG. 2, the presser foot 1 includes the cloth presser member 2, which comes in contact with a fabric (not illustrated) on a throat plate 18 to hold the fabric in the vicinity of sewing needles 17, and a connection member 19, which is provided on the upper surface side of the cloth presser member 2 and which is connected to the presser holder 8.

As illustrated in FIG. 2, the spreader drive mechanism 4 is housed between the cloth presser member 2 and the connection member 19 of the presser foot 1. Together with the spreader drive mechanism 4, except for the arm portions 13, the spreader 3 is also housed between the cloth presser member 2 and the connection member 19. Thus, it is possible to prevent an operator, a fabric piece, or the like from accidentally coming in contact with the spreader 3 and the spreader drive mechanism 4 during a sewing operation.

As illustrated in FIG. 1 and FIG. 3, the slider 15 of the spreader drive mechanism 4 is connected to the link mechanism 6. The link mechanism 6 transmits the reciprocating motion, which is generated by the reciprocating motion conversion mechanism 5, to the slider 15 of the spreader drive mechanism 4. The reciprocating motion conversion mechanism 5 converts the rotation of the upper shaft 7 into a reciprocating motion.

Figure 5:
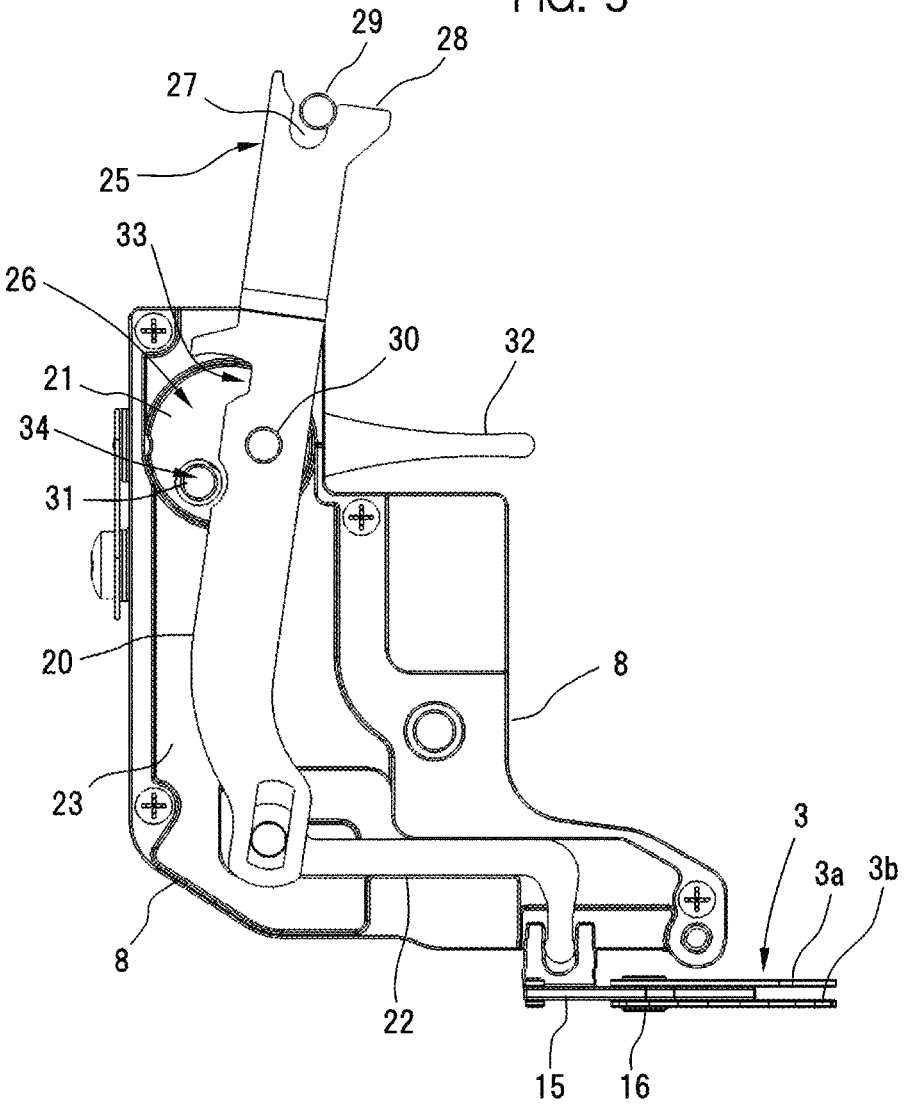
FIG. 5 is an explanatory side view illustrating the configuration of a link mechanism.

As illustrated in FIG. 1 and FIG. 5, the link mechanism 6 includes a link member 20 that vertically extends, a swing support part 21 that swingably supports the link member 20, and an advancing/retreating member 22 connected to the bottom end of the link member 20, and is accommodated in a link mechanism housing 23 of the presser holder 8.

Figure 4:
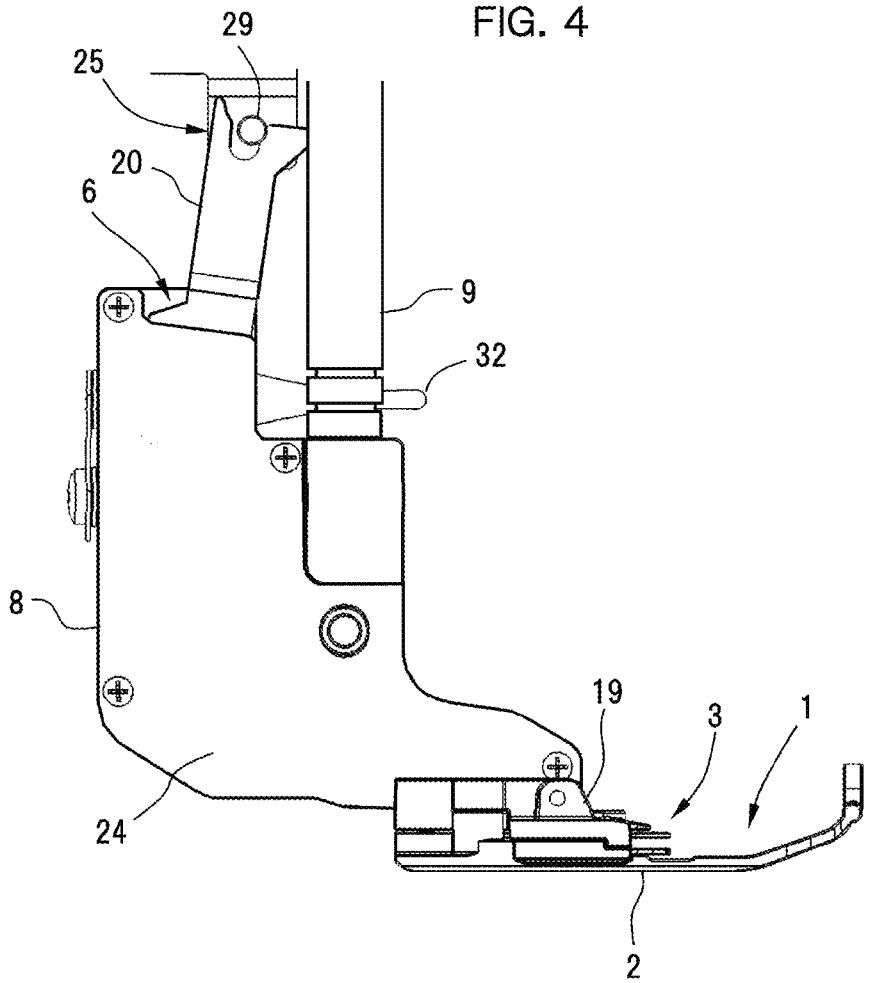
FIG. 4 is an explanatory side view of the presser foot and a presser holder.

Further, the link mechanism 6 in the state of being accommodated in the link mechanism housing 23 of the presser holder 8 is covered by a cover member 24 and concealed inside the presser holder 8 as illustrated in FIG. 4. This prevents contact with the link mechanism 6 from outside and improves the appearance since the mechanical parts are not exposed.

As illustrated in FIG. 5, the advancing/retreating member 22 is connected to the slider 15 of the spreader drive mechanism 4, and converts the swing of the link member 20 into the advancing/retreating motion to drive the slider 15.

An upper connection part 25 connected to the reciprocating motion conversion mechanism 5 is provided at the upper end of the link member 20. The upper connection part 25 is disconnectably connected by a link disconnection mechanism 26.

Figure 6:
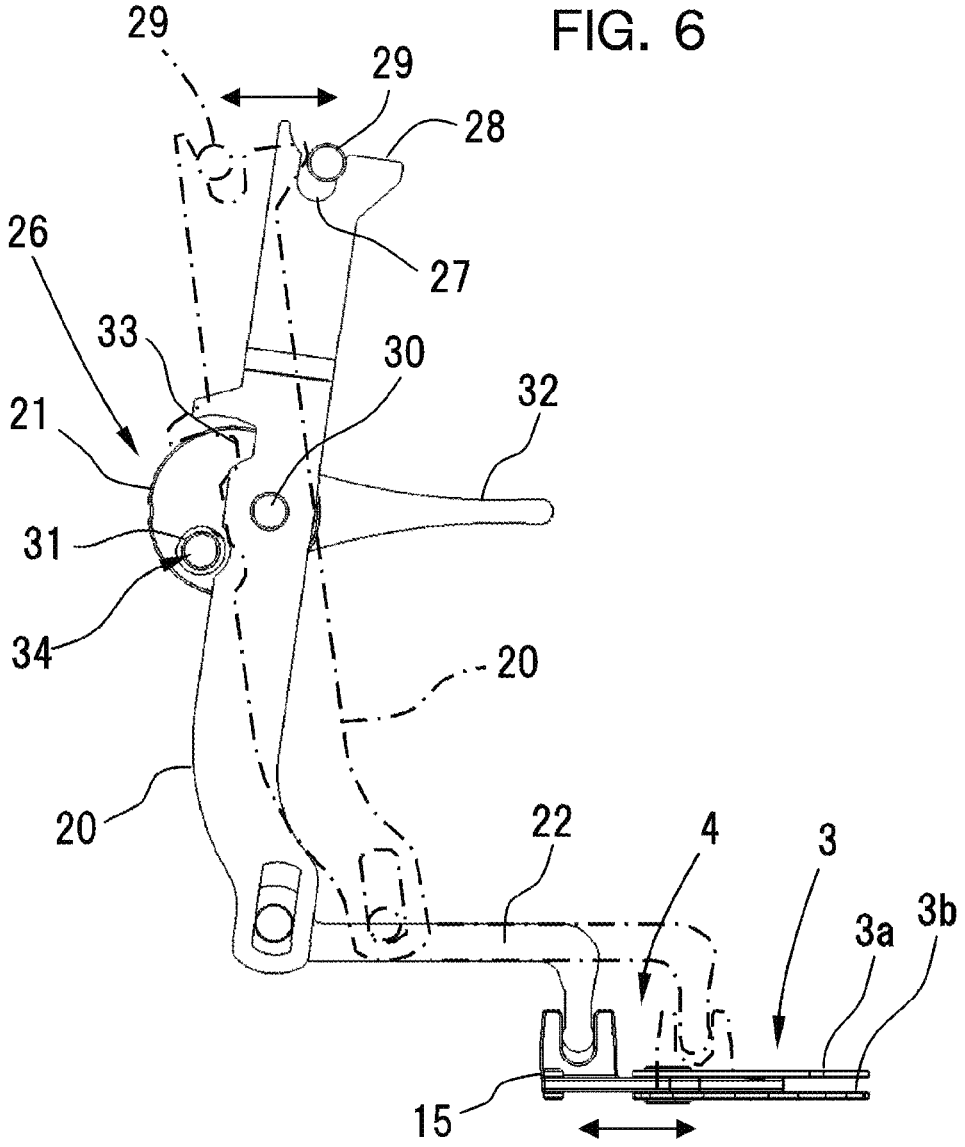
FIG. 6 is an explanatory diagram illustrating an essential section of the link mechanism that has been connected to a transmission pin.
Figure 7:
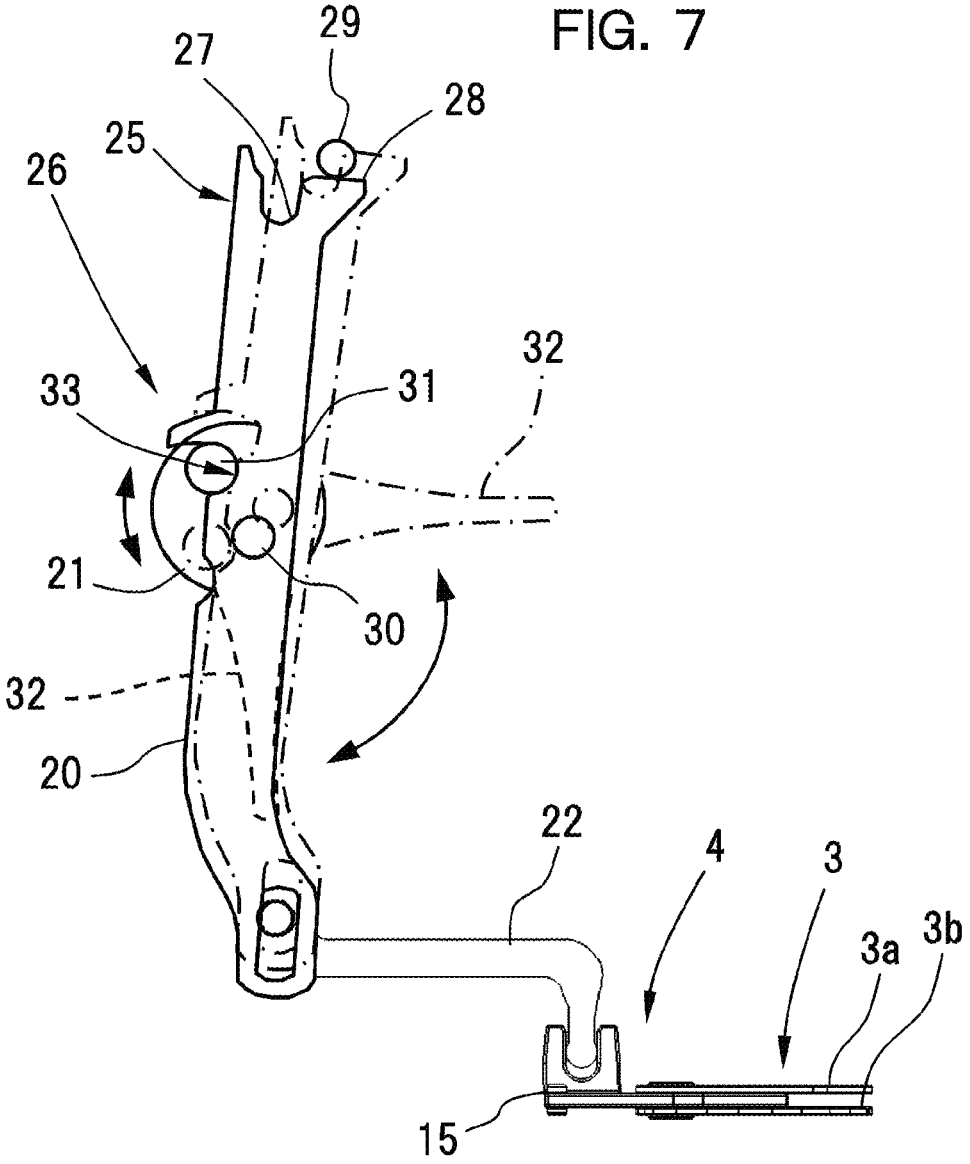
FIG. 7 is an explanatory diagram illustrating the operation of a link disconnection mechanism.

As illustrated in FIG. 6 and FIG. 7, a recessed portion 27 and a contact surface 28 are formed on the upper connection part 25. A transmission pin 29 of the reciprocating motion conversion mechanism 5, which will be described later, is disengageably engaged with the recessed portion 27. The contact surface 28 is formed continuously from one upper edge of the recessed portion 27.

As illustrated in FIG. 5, the swing support part 21 is provided with a support shaft 30, which serves as a swing fulcrum for the link member 20. Further, the swing support part 21 also serves as a constituent part of the link disconnection mechanism 26 as a moving member in the present invention. More specifically, the link disconnection mechanism 26 includes a pressing pin 31 provided on the swing support part 21 and an operation lever 32 for rotatively operating the swing support part 21.

When performing a top decorative stitching operation, the operation lever 32 is raised (set to a horizontal state), as illustrated in FIG. 6. When the operation lever 32 is raised, the transmission pin 29 engages with the recessed portion 27 of the link member 20, and the pressing pin 31 is positioned at a second position 34 to be in a retreated state so as not to interfere with the link member 20. When the top decorative sewing operation is performed in this state, the transmission pin 29 of the reciprocating motion conversion mechanism 5 swings the link member 20 to drive the slider 15 of the spreader drive mechanism 4 via the advancing/retreating member 22 thereby to rotate the spreader 3.

When the top decorative stitching operation is not performed, the operation lever 32 is lowered, as illustrated in FIG. 7. When the operation lever 32 is lowered, the support shaft 30 of the swing support part 21 moves downward, and the link member 20 moves downward, as indicated by the chain line in FIG. 7. At the same time, the pressing pin 31 presses the link member 20 at a first position 33, and the link member 20 rotates clockwise around the support shaft 30.

Thus, the transmission pin 29 comes out of the recessed portion 27 of the link member 20, disconnecting the reciprocating motion conversion mechanism 5 and the link mechanism 6. When the pressing pin 31 moves to the first position 33, the advancing/retreating member 22 moves to the retreat position and stops.

At this time, the transmission pin 29 that has come out of the recessed portion 27 is positioned on the contact surface 28. Further, the advancing/retreating member 22 is fixed at the retreat position, and the slider 15 therefore separates the two arm portions 13 of the spreader 3 from each other. This state is maintained.

When the operation lever 32 is raised from the lowered state thereof, the pressing pin 31 moves to the second position 34, thus allowing the link member 20 to freely swing. At the same time, the support shaft 30 is displaced upward, causing the link member 20 to move upward, and the transmission pin 29 comes in contact with the contact surface 28 of the link member 20. At this time, the link member 20 pushes up the transmission pin 29, but the transmission pin 29 is urged downward by a pull spring 54 of a presser height detector 44, which will be described later, so that the transmission pin 29 moves upward together with the link member 20.

Then, when the sewing operation is started, the reciprocating motion conversion mechanism 5 starts the reciprocating motion, causing the transmission pin 29 to slide on the contact surface 28 and fit in the recessed portion 27. This connects the reciprocating motion conversion mechanism 5 and the link mechanism 6, enabling a smooth start of the sewing operation.

Figure 8:
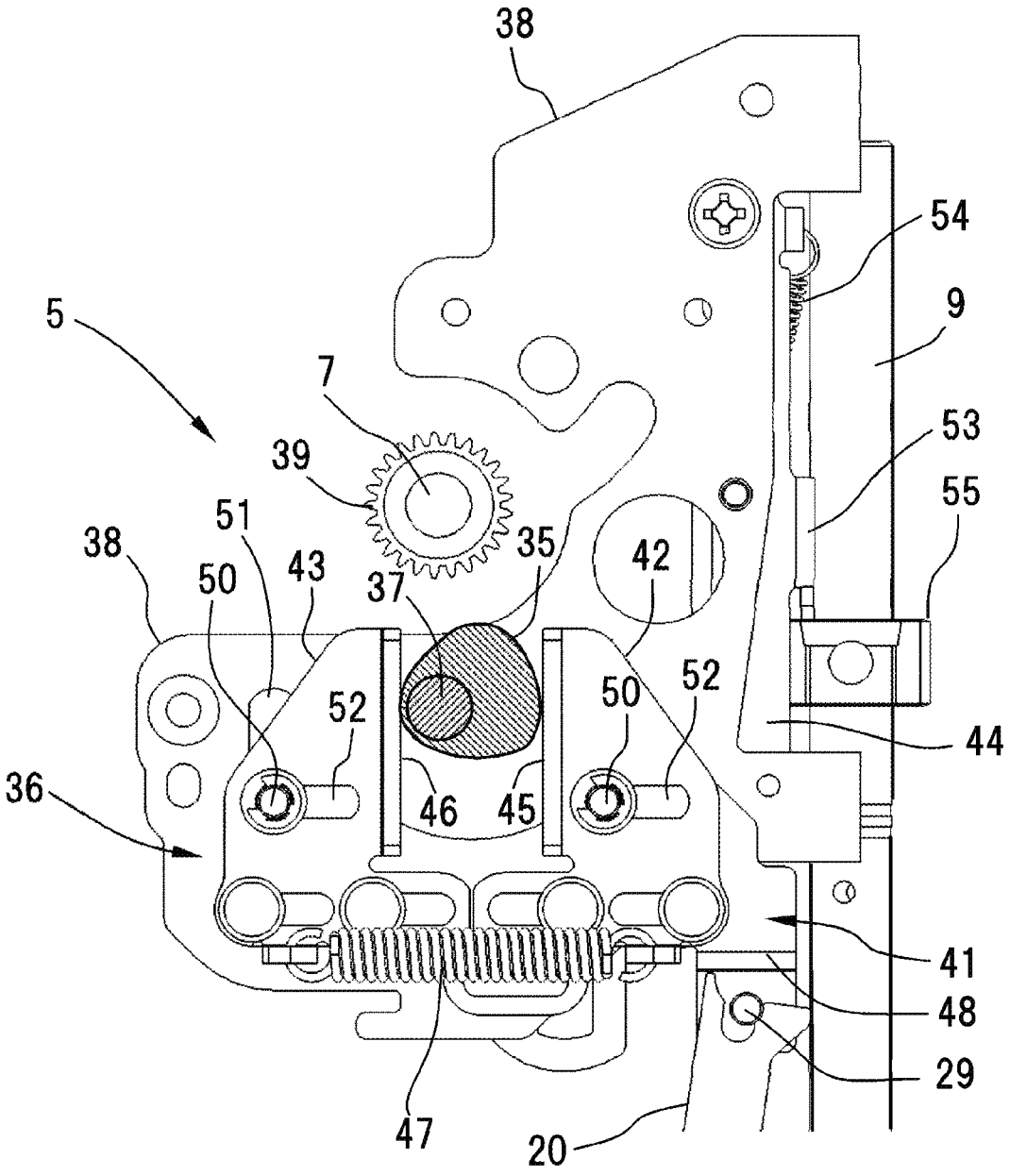
FIG. 8 is an explanatory diagram illustrating a schematic configuration of a reciprocating motion conversion mechanism in side view.

As illustrated in FIG. 8, the reciprocating motion conversion mechanism 5 includes a cam 35 and a yoke 36. A cam shaft 37 is fixed to a mounting plate 38. The cam shaft 37 supports the cam 35 and a driven gear 40. The cam 35 and the driven gear 40 are integrally formed. The driven gear 40 engages with a drive gear 39 of the upper shaft 7, as illustrated in FIG. 1, and decreases the rotational speed of the upper shaft 7 to rotate the cam 35.

Figure 9:
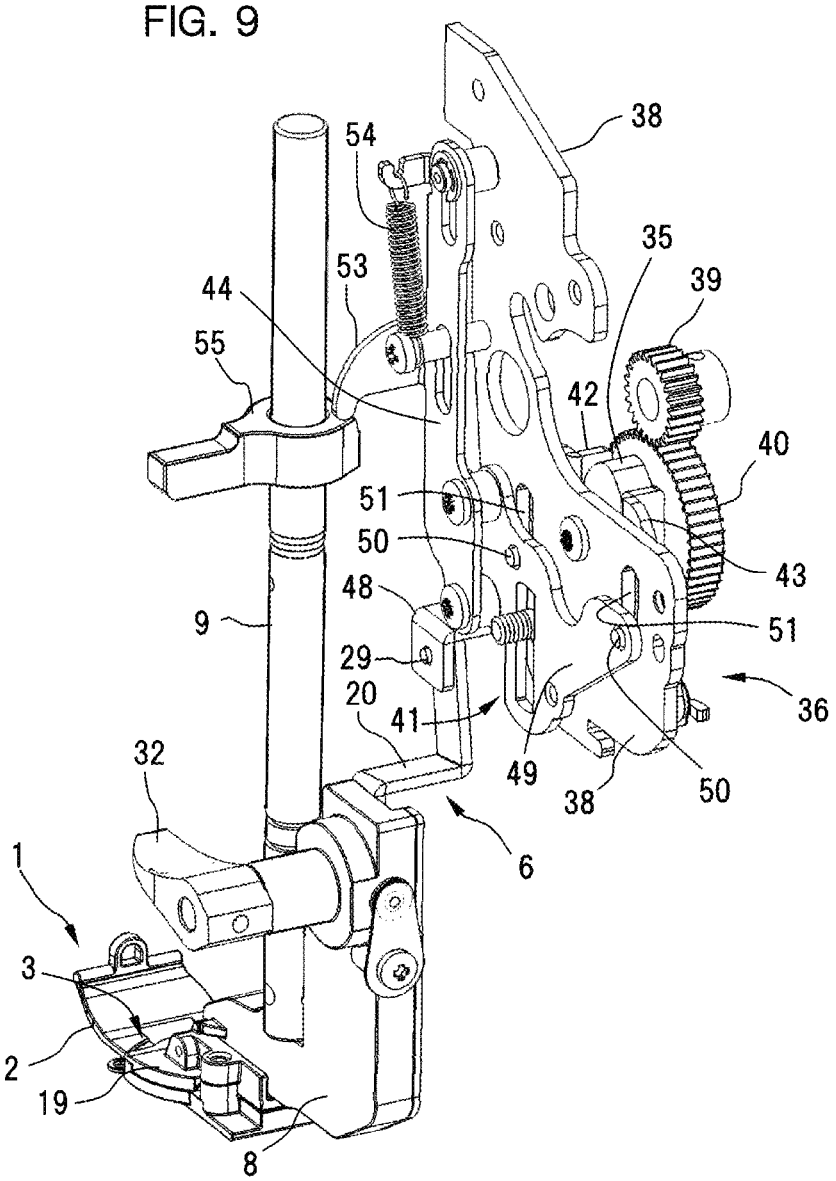
FIG. 9 is an explanatory perspective view illustrating a schematic configuration of the reciprocating motion conversion mechanism.

As illustrated in FIG. 8 and FIG. 9, the yoke 36 includes a base 41, a pair of cam contact members (a first cam contact member 42 and a second cam contact member 43), and the presser height detector 44. The base 41 has the transmission pin 29 for connection with the link mechanism 6.

The first cam contact member 42 includes a first wall portion 45 that contacts the cam 35, and the second cam contact member 43 includes a second wall portion 46 that opposes the first wall portion 45 and contacts the cam 35. When the cam 35 rotates to cause the first cam contact member 42 to move via the first wall portion 45, the base 41 moves to one side accordingly. When the cam 35 rotates and causes the second cam contact member 43 to move via the second wall portion 46, the base 41 moves to the other side accordingly.

The first cam contact member 42 and the second cam contact member 43 can be moved in directions away from each other, and are connected via a pull spring 47, which is an urging means for urging these members in directions toward each other.

When the distance between the first wall portion 45 and the second wall portion 46 is a predetermined distance (minimum distance), the pull spring 47 fixes, using its urging force, the first cam contact member 42 and the second cam contact member 43 to the base 41.

The base 41 is composed of a first moving member 48 and a second moving member 49. The first moving member 48 is provided with the transmission pin 29, and the presser height detector 44 is connected to the second moving member 49. The base 41 is supported by the mounting plate 38 in such a manner as to be movable in the lateral direction and the vertical direction.

More specifically, the second moving member 49 has a pair of connection pins 50. The two connection pins 50 pass through the mounting plate 38 and are connected to the first moving member 48. The mounting plate 38 has a pair of vertically elongated holes 51, and the first moving member 48 has a pair of horizontally elongated holes 52 extending in a direction orthogonal to the vertically elongated holes 51 in the mounting plate 38. The connection pins 50 extending from the second moving member 49 pass through the vertically elongated holes 51 in the mounting plate 38 and pass through the horizontally elongated holes 52 in the first moving member 48.

Thus, when the cam 35 rotates, the first cam contact member 42 and the second cam contact member 43 are alternately pushed, causing the first moving member 48 to reciprocate in the lateral direction. At this time, the first moving member 48 reciprocates relative to the connection pins 50, which are in fixed positions, via the horizontally elongated holes 52. Further, when the presser height detector 44 moves up and down, the connection pins 50 are guided by the vertically elongated holes 51 in the mounting plate 38, and the second moving member 49 and the first moving member 48 move up and down together.

The presser height detector 44 moves up and down, following the up and down movement of the presser rod 9, which supports the presser holder 8. More specifically, the presser height detector 44 has a connection claw piece 53 and is urged downward by the pull spring 54. A contact member 55, which causes the connection claw piece 53 to contact the upper surface thereof, is fixed to the presser rod 9.

When the presser rod 9 moves upward, the contact member 55 pushes up the connection claw piece 53 against the urging by the pull spring 54, causing the presser height detector 44 to move upward. As the presser height detector 44 moves upward, the yoke 36 moves upward.

Meanwhile, when the presser rod 9 moves downward, the contact of the connection claw piece 53 with the contact member 55 is maintained by the urging of the pull spring 54, and the presser height detector 44 moves downward. As the presser height detector 44 moves downward, the yoke 36 moves downward.

In the meantime, when, for example, the thickness of fabric increases during a sewing operation, the presser holder 8 and the link mechanism 6 are both displaced upward, and the distance between the transmission pin 29 and the support shaft 30 of the link member 20 decreases, thus increasing the rotational angle of the spreader 3.

Therefore, the present embodiment is configured as described above such that the vertical movement of the presser rod 9, which supports the presser holder 8, is transmitted to the yoke 36 by the presser height detector 44. Thus, even if the thickness of fabric changes during a sewing operation, the position of the yoke 36 relative to the presser holder 8 does not change, making it possible to prevent changes in the distance between the transmission pin 29 and the support shaft 30 of the link member 20.

Consequently, even if the thickness of fabric changes during a sewing operation, the reciprocating motion conversion mechanism 5 configured as described above is not affected by such a fabric thickness change, and can transmit accurate reciprocating motions to the spreader 3, thus permitting a smooth sewing operation.

Further, as illustrated in FIG. 1, the spreader 3 rotates by the reciprocating motion transmitted to the spreader drive mechanism 4 from the reciprocating motion conversion mechanism 5 via the link mechanism 6. If, however, an external force is applied to the spreader 3 that stops the rotation thereof in such a case where, for example, an operator performing a sewing operation comes in contact with the spreader 3 that is rotating, various parts may be damaged, or smooth rotation of the upper shaft 7 may be disturbed.

Therefore, as illustrated in FIG. 8, the reciprocating motion conversion mechanism 5 is provided with a protective function for a case where the spreader 3 should inadvertently stop. More specifically, as described above, the yoke 36 is provided such that the first cam contact member 42 and the second cam contact member 43 are movable in directions away from each other, and both are urged by the pull spring 47 in directions toward each other.

To specifically describe the protective function, if, for example, an operator comes in contact with the spreader 3 during a sewing operation, the spreader 3 tends to stop. On the other hand, the driving force transmitted to the yoke 36 from the cam 35 of the reciprocating motion conversion mechanism 5 tends to rotate the spreader 3 via the link mechanism 6 or the spreader drive mechanism 4. If such opposing forces are applied to the spreader 3, the spreader drive mechanism 4, the link mechanism 6, and the reciprocating motion conversion mechanism 5, then any one of these may be subjected to an excessive load and damaged.

As a solution, in the reciprocating motion conversion mechanism 5 of the present embodiment, if a force that causes the reciprocating motion of the base 41 to stop is applied via the link mechanism 6, then only the first cam contact member 42 pushed by the cam 35 moves in a direction away from the second cam contact member 43 against the urging by the pull spring 47, or only the second cam contact member 43 pushed by the cam 35 moves in the direction away from the first cam contact member 42 against the urging by the pull spring 47 thereby to cause the cam 35 to idle, thus generating no reciprocating motion at the base 41.

Consequently, even if a situation takes place, in which the rotation of the spreader 3 stops during a sewing operation, the rotation of the cam 35 is not transmitted to the base 41 of the yoke 36, thus making it possible to prevent damage or the like to the components.

In the embodiment described above, the example has been shown, in which the two rotating members 3*a*, 3*b* of the spreader 3 have the symmetrical shape, and the two rotating members 3*a*, 3*b* are coaxially supported by the single pivot shaft 10; however, the present invention is not limited thereto. Although not illustrated, the rotating members of the spreader may have different shapes, and two pivot shafts may be provided to support the rotating members by different pivot shafts.

DESCRIPTION OF REFERENCE NUMERALS

1 . . . presser foot; 2 . . . cloth presser member, 3 . . . spreader, 3*a*, 3*b* . . . rotating member, 4 . . . spreader drive mechanism; 5 . . . reciprocating motion conversion mechanism; 6 . . . link mechanism; 7 . . . upper shaft; 8 . . . presser holder, 9 . . . presser rod; 10 . . . pivot shaft; 11 . . . main body; 12 . . . cam groove; 13 . . . arm portion; 14 . . . thread hole; 15 . . . slider; 16 . . . cam follower; 19 . . . connection member; 20 . . . link member, 21 . . . swing support part (moving member); 23 . . . link mechanism housing; 24 . . . cover member; 26 . . . link disconnection mechanism; 27 . . . recessed portion; 28 . . . contact surface; 29 . . . transmission pin; 30 . . . support shaft (fulcrum); 32 . . . operation lever, 35 . . . cam; 36 . . . yoke; 41 . . . base; 44 . . . presser height detector, 45 . . . first wall portion (wall portion);

46 . . . second wall portion (wall portion); and 47 . . . pull spring (urging member).

The invention claimed is:

1. A sewing machine that forms a decorative stitch on an upper surface of a fabric, the sewing machine comprising:

a presser foot which is adjacent to a sewing needle moving up and down and which holds down a fabric on a throat plate; a presser holder which supports the presser foot; a rotatable spreader having a thread hole through which sewing thread vertically passes; a spreader drive mechanism which drives a rotation of the spreader; a reciprocating motion conversion mechanism which is positioned above the throat plate and converts a rotation of an upper shaft into a linear reciprocating motion in a longitudinal direction; and a link mechanism which transmits a reciprocating motion produced by the reciprocating motion conversion mechanism to the spreader drive mechanism, wherein the spreader and the spreader drive mechanism are both provided in the presser foot, and the link mechanism is provided in the presser holder, wherein the presser foot includes a pivot shaft which is positioned behind the sewing needle and vertically extends, wherein the spreader includes a main body supported by the pivot shaft, a cam groove which is formed in the main body and curved along a rotation path, and an arm portion which extends forward from the main body and has the thread hole formed therein, and wherein the spreader drive mechanism includes a slider which moves toward and away from the pivot shaft by a reciprocating motion transmitted from the reciprocating motion conversion mechanism via the link mechanism, and a cam follower which is provided on the slider and which rotates the spreader by sliding along the cam groove of the spreader as the slider moves.

2. The sewing machine according to claim 1, wherein the thread hole is formed in an elongated hole shape, and the elongated hole shape is gradually enlarged as a distance from the pivot shaft increases.

3. The sewing machine according to claim 1, wherein the spreader is composed of a pair of symmetrically-shaped rotating members including the main bodies, the cam grooves, and the arm portions, both of the rotating members are rotatably supported on the pivot shaft, and the thread holes of both members move in opposite directions from each other by a movement of the cam follower as the slider advances or retreats.

4. The sewing machine according to claim 1, wherein the presser foot includes a cloth presser member which is brought into contact with a fabric on the throat plate, and a connection member which is provided on an upper surface side of the cloth presser member and connected to the presser holder, and the spreader and the spreader drive mechanism are provided between the cloth presser member and the connection member.

5. The sewing machine according to claim 1, wherein the link mechanism includes a link member which is elongated in a vertical direction along the presser holder, and a swing support part provided on the presser holder to support the link member in such a manner as to be swingable between an upper end and a lower end of the link member, and a reciprocating motion of the reciprocating motion conversion mechanism is input from the upper end of the link member and the reciprocating motion is output from the lower end of the link member toward the spreader drive mechanism.

6. The sewing machine according to claim 5, wherein the presser holder includes a link mechanism housing which accommodates the link mechanism, and a cover member which detachably seals the link mechanism housing to conceal the link mechanism accommodated in the link mechanism housing.

7. The sewing machine according to claim 1, wherein the reciprocating motion conversion mechanism includes: a cam rotated by the upper shaft; a yoke which converts a rotation of the cam into a linear reciprocating motion; a transmission pin which transmits the reciprocating motion of the yoke to the link mechanism; and a presser height detector for maintaining a constant distance between the transmission pin and a fulcrum of the link mechanism, and the presser height detector is supported on a frame of the sewing machine in such a manner as to be vertically movable, and connects a presser rod, which supports the presser holder, and the yoke.

8. The sewing machine according to claim 7, wherein the yoke includes a base on which the transmission pin is provided, and two wall portions which are positioned in opposing directions via a rotating shaft of the cam and which are in contact with the cam, the base includes an urging member which supports both wall portions in such a manner as to be separately and horizontally movable and which urges both wall portions in directions toward each other, and both wall portions move against urging of the urging member in directions away from each other to release transmission of power from the reciprocating motion conversion mechanism to the link mechanism in response to a rotational stopping force applied to the spreader.

9. The sewing machine according to claim 5, wherein the link mechanism includes a link disconnection mechanism which is connected to the reciprocating motion conversion mechanism by engaging with a part of the reciprocating motion conversion mechanism and which disconnects from the reciprocating motion conversion mechanism by separating from the part of the reciprocating motion conversion mechanism, and the link disconnection mechanism includes an operation lever for performing a disconnecting operation, and a moving member which moves the link member in a direction for releasing engagement with the reciprocating motion conversion mechanism via the swing support part by the disconnecting operation performed by the operation lever.

10. The sewing machine according to claim 9, wherein the moving member further moves the spreader to a predetermined position along an advancing/retreating direction via the link member by the disconnecting operation of the operation lever.

11. The sewing machine according to claim 10, wherein the reciprocating motion conversion mechanism includes a transmission pin urged downward, and the link mechanism includes, in an upper end portion of the link member, a recessed portion, which detachably engages with the transmission pin, and a contact surface which is formed continuously from an upper edge of one side of the recessed portion and with which the transmission pin can contact from above.

* * * * *